United States Patent [19]

Schmitter

[11] 4,077,249

[45] Mar. 7, 1978

[54] CUTTING OR BENDING TOOL

[76] Inventor: Erich K. Schmitter, Industriestrasse 5, 6369 Dortelweil b. Ffm., Germany

[21] Appl. No.: 652,322

[22] Filed: Jan. 26, 1976

[30] Foreign Application Priority Data

Jan. 27, 1975 Germany ..... 2503131

[51] Int. Cl.[2] ..... B21D 9/08

[52] U.S. Cl. ..... 72/389; 72/409; 254/69

[58] Field of Search ..... 72/389, 385, 386, 380, 72/409; 254/69, 106

[56] References Cited

U.S. PATENT DOCUMENTS

| | | | |
|---|---|---|---|
| 2,174,489 | 9/1939 | Groves | 254/69 |
| 2,382,266 | 8/1945 | Simonsen | 72/35 |
| 2,491,041 | 12/1949 | Hasselquist | 254/69 |
| 2,638,318 | 5/1953 | Nampa | 254/69 |
| 2,670,174 | 2/1954 | Lucker | 254/106 |
| 2,910,108 | 10/1959 | Fike | 72/35 |
| 3,091,432 | 5/1963 | Chartier | 254/69 |
| 3,464,254 | 9/1969 | Le Breton | 72/389 |
| 3,822,578 | 7/1974 | Le Breton | 72/389 |

FOREIGN PATENT DOCUMENTS

| | | | |
|---|---|---|---|
| 899,105 | 12/1953 | Germany | 254/106 |

*Primary Examiner*—C.W. Lanham
*Assistant Examiner*—Gene P. Crosby
*Attorney, Agent, or Firm*—Richard L. Schwaab

[57] ABSTRACT

The specification describes a tool more especially for bending tubes and rods in which the rod or tube is acted upon by a pressing part mounted on a thrust rod. The thrust rod is arranged to be moved along its axis by means of a lever operated advancing lever which makes frictional engagement at edges engaging the thrust rod on opposite sides of the latter. Between repeated reciprocating movements of the advancing lever the thrust rod is retained by a sprag having a hole through which the thrust rod passes. This hole has diametrally opposite clamping edges for engaging the thrust rod. The thrust rod is adapted to be released by a blow against a release knob which indirectly acts on the sprag bringing it out of engagement with the thrust rod.

18 Claims, 8 Drawing Figures

CUTTING OR BENDING TOOL

BACKGROUND OF INVENTION

1. Field to Which Invention Relates

The invention relates to a tool, more particularly a tool for bending pipes, rods, bands or girders, comprising a pressing part adapted to slide with the use of a thrust rod, and one or more counter pressing parts adapted to be fixed on the tongs. For the sake of simplicity, the novel tool is in the following specification referred to as a tongs.

2. The Prior Art

Tongs of this type all comprise toothed thrust rods, something which leads to a series of disadvantages. In the case of such prior art tongs the thrust rod can only be advanced in steps, the length of the steps corresponding to the pitch of the individual teeth. Furthermore they have the disadvantage that on moving out the thrust rod also a number of the laterally projecting teeth project from the tongs housing and if the thrust rod is rapidly withdrawn into the housing again this may injure the user. Furthermore there is the disadvantage that these teeth of the thrust rod and the corresponding teeth of the acting mechanism are subject to wear in the case of long periods of use on their front edges so that reliable operation of such tongs is not always ensured or the tongs may only operate for a relatively short time.

SUMMARY OF INVENTION

One aim of the present invention is that of providing a tongs of the initially specified type which does not have the disadvantage of prior art tongs.

This aim is achieved in the case of tongs of the initially mentioned type by a thrust rod with a smooth surface, on which a sprag and an advancing lever are fitted, whose openings through which the thrust rod extends have opposite clamping edges, a first spring, which urges the advancing lever with its one end against an inner end section of the tongs lever located in the rest position and accordingly urges with an upper edge zone and the lower edge zone of its opening against the thrust rod with a tilting action, a second spring between the advancing lever and the sprag, which is journalled for pivoting movement with respect to the housing and the second spring so urges the sprag into its locking position making tilting engagement with its upper edge part and the lower edge part of its opening on the thrust rod that an acutation of the tongs lever the advancing lever is advanced with a tilting action to a great extent, the sprag is sufficiently released and the thrust rod is advanced and a release means which unjams the advancing lever and the sprag.

The advantage obtained with the invention is to be regarded as residing more particularly in that the use of a thrust rod with a smooth surface is made possible. This leads to the further advantages that such a tongs can be used without the danger of injury to the user, since the thrust rod does not have any projecting parts and the thrust rod is not worn even in the case of pronlonged periods of use and accordingly always operates satisfactorily. There is the further advantage that the thrust rod is continuously, i.e., not in steps adjustable. This stepless displacement of the thrust rod makes possible extremely precise bending, as for example of tubes or pipes with an accuracy to fractions of one degree of angle using such a tongs.

On each actuation of the tongs lever the advancing lever is tilted towards the thrust rod to a greater extent than in its rest position and is then moved clear again. As a result the thrust rod is entrained. Simultaneously however the second spring, which is arranged between the advancing lever and the sprag in a compressed condition, is relaxed so that the sprag releases the thrust rod during this stroke for displacement. If the tongs lever is released the advancing lever moves back into its normal position while the sprag reliably prevents any sliding back of the thrust rod, since under the increasing pressure of the second spring it is swung into its locking position. If the tongs is used to bend an article, which on releasing the tongs lever exert the pressure of the thrust rod and which tends to force the thrust rod into the housing, this pressure serves to force the sprag, jamming by tilting against the thrust rod, is forced to an even greater degree into its locking position jammed up against the thrust rod, so that a sliding back of the thrust rod is impossible.

If the thrust rod is to be withdrawn back into the tongs housing after bending a tube for example, by means of the releasing device via a linkage a pressure is exerted both on the sprag and also on the advancing lever and this pressure swings the two out of their jammed position so that the thrust rod is released. Since the latter has a smooth surface and is only locked by the jamming clamping edges of the openings in the advancing lever and the sprag, a minimum clearance of the clamping edges of these two levers from the surface of the thrust rod is sufficient to release the latter. The advancing lever and the sprag do therefore not to be swung for more than a minimum angle for withdrawing the thrust rod in the case of the device, the angle being substantially smaller than the necessary movement of the locking means in the case of prior art racks, since in this case for release movements are required whose displacement must be in accordance with the height of the teeth used for the rack etc.

The thrust rod and the openings in the advancing lever and in the sprag can have a rectangular cross-section. Preferably the thrust rod and the openings of the advancing lever and the sprag have a round constant cross-section. This development of the invention involves the advantage that the thrust rod and the openings in the advancing lever and the sprag are particularly simple and cheap to produce.

In accordance with a further development of the invention the advancing lever has at an end zone, remote from the tongs lever, a projection, which in the rest position of the tongs urges the sprag, which at one end is pivotally mounted in the housing, towards its locking position. This further development involves the advantage that the releasing means can be constructed in a particularly simple manner. In this case it only has to act on the sprag itself and swing it out of its clamping position. In this case simultaneously via the projection on the advancing lever, which is displaced on swinging the sprag, the advancing lever is moved out of its locking position, so that the thrust rod can be rejected into the tongs housing.

The openings in the advancing lever and the sprag can be inclined in opposite directions with respect to the thrust rod and the engagement position for the projection on the advancing lever can be arranged between the thrust rod and the pivot point of the sprag on the latter.

Advantageously the advancing lever and the sprag are so constructed that the openings have such upper and opposite lower edges that an optimum clamping or jamming action is obtained.

In accordance with a further development of the invention the advancing lever has a roller adapted to rotate and arranged perpendicularly with respect to the longitudinal direction of the advancing lever and in every position this roller is urged into engagement with an operating surface arranged on the inner section of the tongs lever. This operating surface is preferably so inclined that the roller and accordingly the preloaded advancing lever experience a force directed against the thrust rod. This further development of the invention offers the advantage that the advancing lever is always correctly adjusted perpendicularly with respect to the thrust rod and is pressed by the first spring into its correct position, in which a lower and an upper edge part of its opening jam up against the thrust rod.

In accordance with a further development of the invention the inclined operating surface of the inner section of the tongs lever can be so shaped that on acting on the tongs lever the operating surface exerts on the roller of the advancing lever a force which remains the same in all angles of tightening. This further development has the advantage that the direction of force, with which the advancing lever is swung into its tilted jamming position, remains the same. This form of construction makes it possible to use a relatively weak first spring between the housing and the advancing body, since owing to the constant torque of the advancing lever exerted on the thrust rod no oversize dimensions of this first spring are called for.

The releasing means can comprise a rod, which on being displaced against the spring force comes into engagement with the sprag and swings the latter out of its tilted jamming position. In accordance with an advantageous development of the invention the releasing device has at the lower end of the tongs handle a release knob, which is connected with the sliding rod and is urged by a compression spring downwardly. In the case of this embodiment of the invention a smart blow from below against the release knob is all that is required to release the thrust rod. By means of the smart blow from below on the release knob the thrust rod is jerked in the direction opposite to the direction of thrust.

Preferably a retracting spring is connected with the housing and with the thrust rod and this spring returns the thrust rod into the tongs housing when the release knob is struck.

In accordance with a further development of the invention the thrust rod has a pin which can be seen through a slot in the housing. On one or both sides of the slot scales can be marked. A second pin opposite to the first pin is guided in a further groove in the housing which cannot be seen from the outside. This prevents twisting of the thrust rod. This further development of the invention makes possible a precise reading of the displacement of the thrust rod and accordingly of the bending carried out, for example of the tube placed between the pressing part and the counter-pressing part. The bending already carried out of a body between the pressing part and the counter-pressing parts depends not only from the degree of displacement of the thrust rod out of the tongs housing but also on the diameter of the tube to be bent. On one side of the slot it is therefore possible to provide a simple scale which corresponds to a bending of the tube of for example 90°. The individual markings of this scale would then indicate the diameter of the tube to be bent.

If for example a tube with a diameter of 17 mm is to be bent, the thrust rod must be advanced out of the tongs housing until the pin connected with the thrust rod and visible through the slot lies on this 90° scale adjacent to the mark which corresponds to the diameter of 17 mm.

At this point attention should be drawn to a special advantage of the tongs in accordance with the invention over known tongs with toothed thrust rods. In the case of known thrust rods after pressing the tongs lever as far as it will go to tooth engagement the tongs lever must be released completely again. This is not necessary with the tongs in accordance with the invention, and it is sufficient only to release the tongs to a slight extent and then to move it back towards the handle again. This offers the advantage that for displacement of the thrust rod by small distances the hand only has to be opened slightly so that substantially more force and "feel" are available than if the fingers of the hand had to be spread out completely again. This advantage is particularly noticible if the thrust rod has been displaced after several complete pressing actions and release of the tongs lever practically into its desired position. If for example the index pin is just short of the marking which indicates that the tube to be bent with a diameter of 17 mm has been bent through 90°, the last slight displacement is carried out by releasing the tongs lever only to a slight extent and then tightening it again, something which can be carried out with much more feel and a higher degree of accuracy.

On the other side of the slot, through which the index pin can be seen on the thrust rod, another scale can be provided corresponding for example to a bending angle of 60°, in the case of which the scale can again indicate the various diameters of the tube to be bent in millimeters.

In accordance with another further development of the invention the front end of the thrust rod has several parts with different diameters for fitting different pressing bodies or tools.

This further development has the advantage that both pressing bodies already commercially available can be used and also other pressing bodies which in accordance with load to be expected have differently dimensioned holes for receiving the front end of the thrust rod.

Naturally it is also possible to mark scales on both sides of the viewing slot in the housing, which correspond to a bending of a tube through 90°. These scales, which again can indicate diameters of the tubes to be bent can correspond to pressing bodies with different degrees of curvature.

In the case of the tongs in accordance with the invention it is also possible to provide a different scales which can be detachable and which have a slot corresponding to the viewing slot. These detachable scales can be so constructed that they can be inserted in a removable manner through the viewing slot into the housing of the tongs. The various scales can then be in accordance with pressing bodies and counter-pressing bodies with different degrees of curvature of different angles of bending and the marks on the scales themselves can indicate respectively the diameter of the tubes to be bent, for example in millimeters.

The use of the tongs in accordance with the invention is certainly not restricted to the bending of articles. The invention also comprises the use of the tongs for punching or notching materials such as sheet metal, bands etc., for lifting articles as for example tightening chains, ropes, wires etc. or rivetting sheet metal, bands, etc., for drawing off, for example, bearings, keyed-on or pressed on hubs, for pressing together various parts as for example sheets to be glued together or to be soldered or welded, or the like. It can also be used for straightening articles and for carrying out all operations possible in accordance with the application in the home, in the workshop or in the factory. For this purpose it is only necessary to fit on suitably shaped pressing parts and counter-pressing parts or tools on the tongs housing. It is also important that the tongs can be used for cutting tubes.

BRIEF DESCRIPTION OF THE DRAWINGS

The invention will now be described in what follows with reference to an embodiment in conjunction with the accompanying drawing.

DESCRIPTION OF PREFERRED EMBODIMENT

Figure 1:
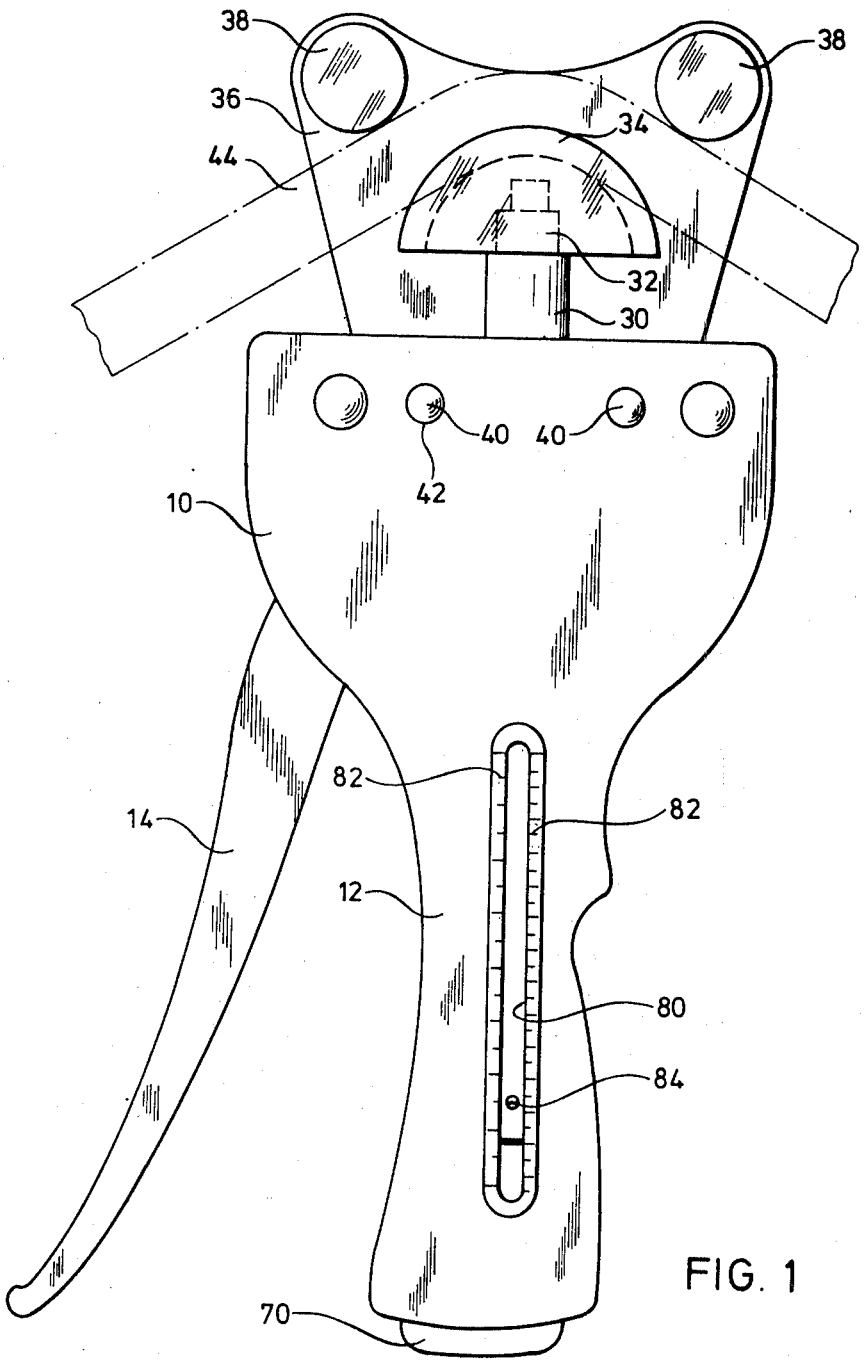
FIG. 1 shows a plan view of a tongs with a pressing part and a counter-pressing part, between which a tube is bent.

In FIG. 1 a tongs is shown, whose housing 10 is partly constructed as a handle 12. On the right-hand side of the housing 10 there is a projecting tongs lever 14.

At the upper end a tooth-less advancing rod extends partly from the housing 10. The advancing rod 30 has at its front end a projecting pin 32 and on this pin a pressing segment 34 is plug-mounted.

On a holding plate 36 two counter-pressing parts 38 are attached. The holding plate 36 is for its part attached by means of two pins 40, which are plugged into receiving holes 42 of the housing 10, on the latter in a removable manner. Between the pressing segment 34 and the counter-pressing parts 38 there is a partly bent article 44 to be seen.

On the flat side of the tongs handle 12 there is a slot 80, along whose two sides respective scales 82 and 83, respectively are provided. In the slot an indexing pin 84 will be seen which is connected with the thrust rod 30. The position of this indexing pin 84 in relation to the two scales indicates how far the thrust rod has been advanced out of the housing 10. These scales can be so calibrated that they indicate the bending of the article 44 in accordance with the diameter of this article.

On the bottom side of the tongs handle 12 a release knob 70 projects downwardly. By means of a blow on this release knob the tongs is unlocked or released, that is to say the thrust rod 30 is released and is retracted by a return spring, later to be described, into the tongs housing 10. As a result the pressing segment 34 is drawn clear of the bent articles so that the article 44 can be removed from the tongs.

Figure 2:
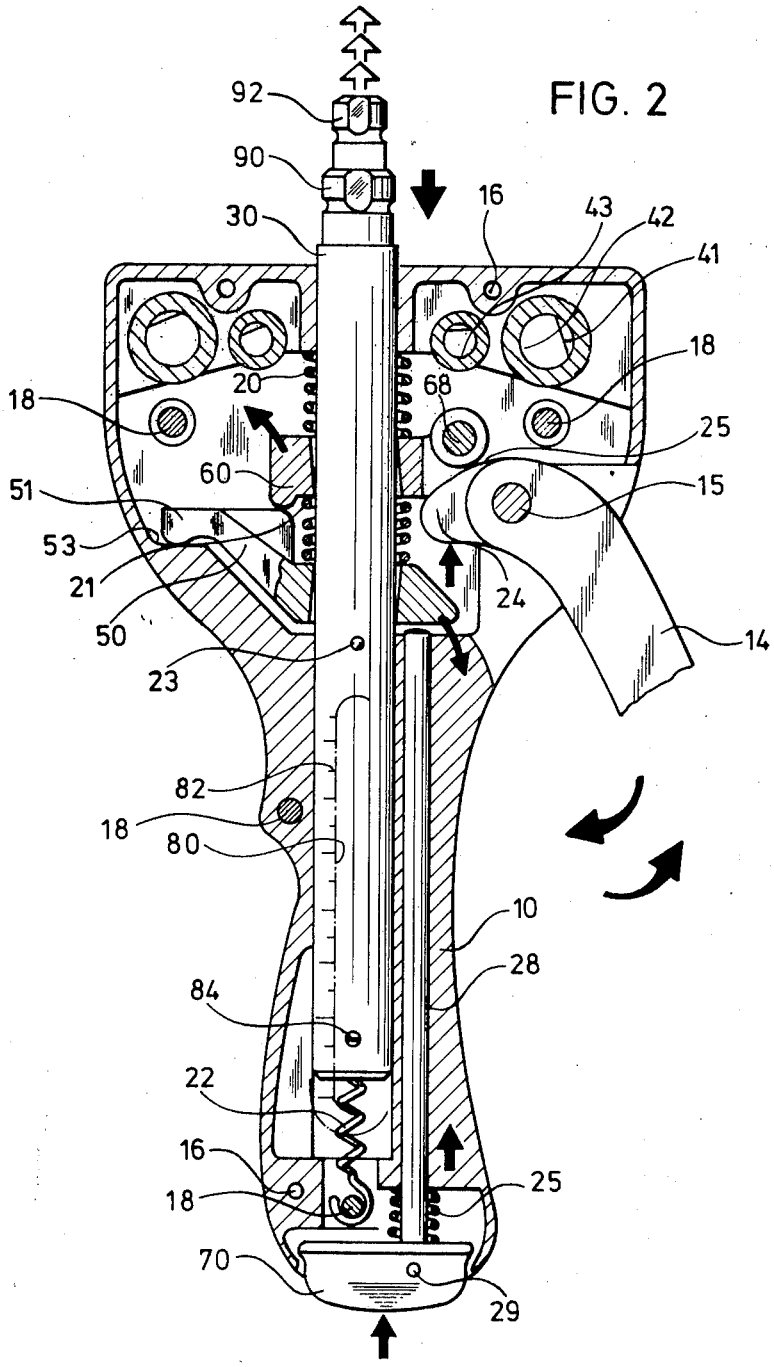
FIG. 2 shows a longitudinal section through a tongs.

FIG. 2 shows a longitudinal section through the tongs of FIG. 1. Since the tongs of FIG. 1 consists or comprises two housing shells, the FIG. 2 simultaneously provides the view of the inner side of the lower housing shell.

This housing shell has two large receiving holes 42 and two smaller receiving holes 43, in which the holding pins 40 of plates 36 can be received, which carry the counter-pressing parts 38. In these receiving holes 42 and 43 small springs 41 will be seen, which arrest the pins in these receiving holes.

In the upwardly projecting walls of the handle shell small holes 16 will be seen, which are constructed so as to be complementary to corresponding pins, which are provided on the other handle shell. These holes 16 and the complementary pins serve for fitting together the two housing shells, which are held together by four screws 18.

Figure 3A:
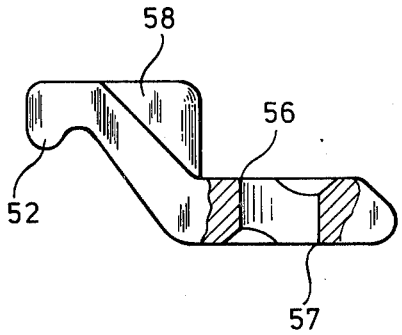
FIG. 3*a* and 3*b* show a side view and, respectively, a plan view of a locking lever.
Figure 3B:
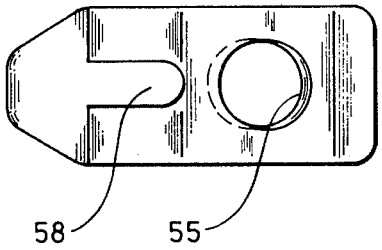

At the position generally coinciding with the center axis of the housing a round thrust rod 30 will be seen, which is guided by the housing both in the upper part of the housing and also in the center part of the housing. On this thrust rod 30 a locking lever or sprag 50 and an advancing lever 60 are placed. The locking lever 60 has a cranked, lateral projection 51, which has a lower rest lying on a shoulder 53 in the handle shell. This locking lever or sprag 50 furthermore has a cylindrical hole 55, which has clamping edges which are inclined to the right with respect to the direction of the thrust rod 30. In the position shown both an upper left-hand part and also a lower right-hand edge part of the hole 55 engages the thrust rod 30. These edge parts form clamping edges 56 and 57 respectively. As can be seen best from FIGS. 3*a* and 3*b*, the sprag 50 has an upwardly projecting plug 58 with a generally horizontal surface.

Above the sprag 50 there is an advancing lever 60 through which the thrust rod 30 passes. This advancing lever 60 has generally in its middle part a cylindrical hole 65, which has an inclined center axis giving rise to clamping edges which are inclined to the left with respect to the direction of the thrust rod 30. In the position shown the advancing lever 60 makes engagement both with an upper right-hand edge part of the hole and also with a lower left-hand edge part of the hole against the thrust rod 30. These engaging edge parts form clamping edges 66 and 67. At its lower left-hand end the advancing lever 60 has a downwardly projecting projection 62, which makes engagement with the generally horizontal surface of the lug 58 of the sprag 50.

Figure 6:
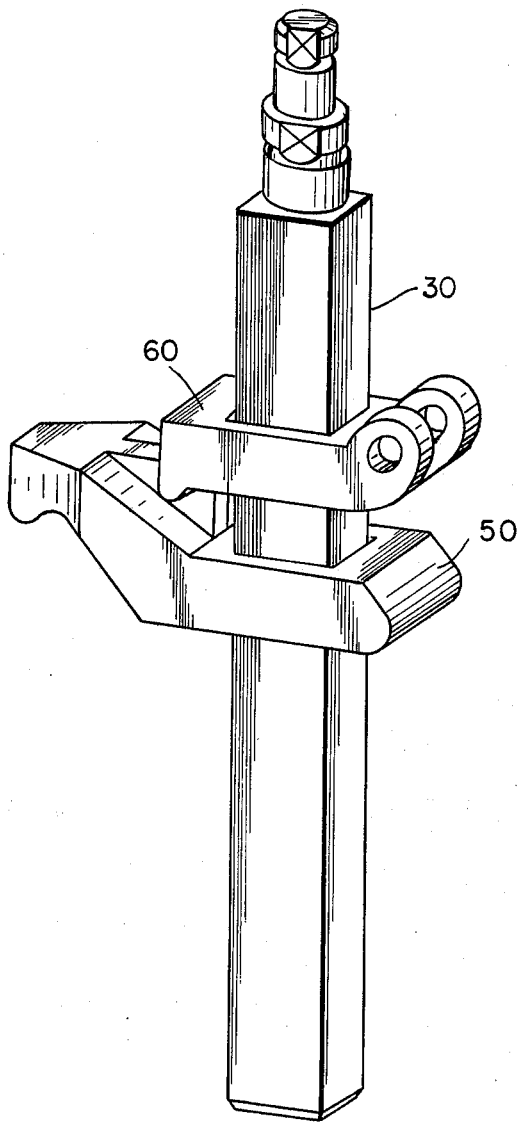
FIG. 6 is a perspective view of an alternative configuration of the thrust rod, sprag, and advancing lever.

While the thrust rod 30 has been described as having a round configuration, and the sprag 50 and advancing lever 60 as having round holes therein, it is also contemplated by the instant invention that, as illustrated in FIG. 6, the thrust rod 30 and the openings of the sprag 50 and advancing lever 60 may have a rectangular cross-section.

Figure 4A:
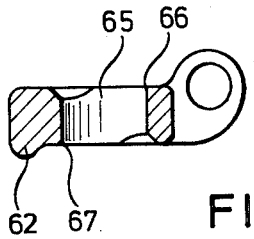
FIGS. 4*a* and 4*b* show a side view and a plan view of an advancing lever.
Figure 4B:
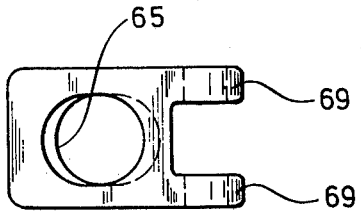
Figure 5:
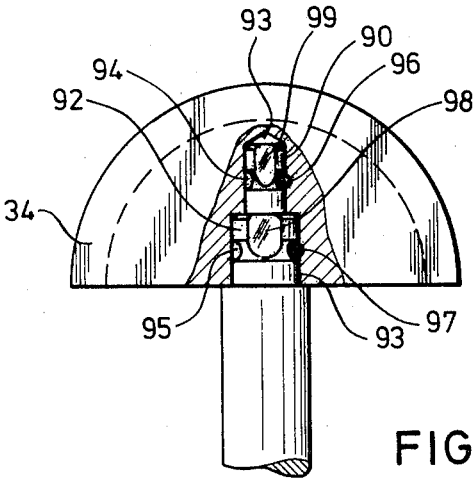
FIG. 5 shows a plan view of the upper end of the thrust rod.

The advancing lever has at its right-hand end part a roller 68, which is fixed between two fork prongs 69 to allow rotation, as will be seen best in FIGS. 4*a* and 4*b*. This roller 68 makes engagement with one end of the tongs lever 14, which is pivoted on a pin 15, see FIG. 2. A first compression spring 20 extends between the advancing lever 60 and the wall of the handle shell and surrounds the thrust rod 30. This compression spring 20 urges the roller 68 against the lever 14, which is represented in its fully displaced end position. The point of engagement of the roller 68 with the lever 14 accordingly simultaneously forms a fulcrum point for the advancing lever 60, which is urged downwards by the compression spring 20 and has its lower projection 62 lying on the lug 58 of the sprag 50. The dimensions are so made that in this position the two clamping edges 66 and 67 of the advancing lever lie against the thrust rod 30. Between the advancing lever 60 and the sprag 50 there is a compression spring 21 on the thrust rod 30. This spring 21 tilts the sprag 50 or clamping lever into its clamping position, in which its clamping edges 56 and 57 jam up against the thrust rod 30. Further points of engagement are required niether for the sprag 50 nor for the advancing lever 60.

The tongs lever 14 has at its inner end an operating surface 24, which is inclined to the left downwardly in relation to the roller 68. Owing to this inclination of the operating surface 24 the roller 68 and accordingly the whole advancing lever 60 are displaced under the force of the first spring 20 to the left.

In the handle part of the housing there is furthermore a slot 80 to be seen, adjacent to which a scale 82 is indicated.

Adjacent to this scale 82 an index pin 84 will be seen, which is connected in a fixed manner with the thrust rod 30. On the lower screw 18 in the tongs handle there is a return spring 22, whose lower end is attached to a holding pin 23 of the thrust rod 30.

At the lower ends of the tongs housing it is furthermore possible to seen the release knob 70, which on its upper side has a larger diameter than the opening in the housing handle, through which the release knob projects. This release knob is urged downwardly by a compression spring 25, which furthermore engages the inner surface 26 of the housing handle. The release knob 70 is connected in a moving manner with a release rod 28 by means of a pin 29. The release rod 28 is also arranged to be displaced in the housing 10.

The tongs described operates in the following manner. On acting on the tongs lever 14 to move it towards the handle 20 the operating surface 24 at the inner end of the tongs lever 14 is raised. As a result this operating surface 24 exerts via the roller 68 a torque on the advancing lever 60, which tilts the lever 60 with a still greater force against the thrust rod 30. Simultaneously, since the clamping edges 66 and 67 can only penetrate to an extremely small amount into the surface of the thrust rod 30, the advancing lever 60 is raised against the spring 20 with its pressing force. Simultaneously the lower projection 62 of the advancing lever 60 is moved clear of the surface of the lug 58. Simultaneously the spring 21 is relaxed so that the sprag 50 can swing to the left and can release the thrust rod 30. During the whole stroke of the thrust rod 30 the sprag 50 remains in this release position.

If the tongs lever 14 is released, it swings back into its spread out position in the case of which the operating surface 25 moves downwards in relation to the roller 68. As a result the pressure on the roller 68 is reduced so that the spring 20 can swing out the advancing lever 60 out of its tilted position and can move it downwardly. Simultaneously the pressure of the spring 21 is increased again so that the sprag 50 is forced immediately into its clamping position. Since the swinging of the sprag 50 out of its tilted position is extremely small — the clamping edges 56, 57 lie always against the thrust rod 30 — a sliding back movement of the thrust rod 30 is out of the question. As soon as the clamping lever or sprag 50 is in its locking position, it is forced by any force which may act on the thrust rod 30 in a still more forceful manner into this tilted or jamming clamping position so that the thrust rod 30 cannot slide back.

This operation described of pressing the tongs lever 14 as far as it will go and releasing it again can be carried out repeatedly until the article, for example a tube, to be bent has been bent through the desired angle.

When this has been carried out the thrust rod 30 must be released so that it can be moved back into the housing 10.

This is carried out by a simple blow from below against the release knob 70. As a result the release rod 28 is displaced back upwards through the housing handle so that its upper end comes to lie from below against the right-hand side of the sprag 50 and swings the latter to the left out of its locking or clamping position. Since the thrust rod 30 has a smooth surface, only a small swinging of the sprag 50 is required in order to release the thrust rod 30.

In the case of this swinging movement of the sprag 50 simultaneously by means of its cam or lug 58 and the lower projection of the advancing lever 60 the latter is swung to the right. As a result the advancing lever is unjammed and releases the thrust rod 30. By means of pressure or a blow on the release knob the two levers are therefore swung out of their jamming positions into the release positions so that the return spring 22 immediately retracts the thrust rod 30.

At the upper end of the thrust rod 30 portions 90 and 92 can be seen having different diameters which serve for fitting different pressing parts as are indicated in FIG. 1 for example. In order to make the drawing more readily intelligible in FIG. 2 no pressing parts and counter-pressing parts are shown.

The pressing parts 34 are provided with a stepped hole 93, into which the parts 90 and 92 of different diameter can be fitted. The portions 90 and 92 have semi-circular grooves 94 and 95, into which pins 96 and 97, which pass through the pressing parts 34 in such a manner that their axes form a tangent with respect to the hole 93, can fit into the grooves. In order to be able to mount the pressing parts 34 on the thrust rod 30 the portions 90 and 92 are provided with surfaces 98 and 99 in such a manner that the pins 96 and 97 can slide past the latter and by rotation of the turning the pressing parts 34 through an angle of 90° the pins can come to lie in the grooves 94 and 95. Owing to this measure the pressing parts 34 are prevented from falling of the thrust rod 30. Turning of the surfaces 98 and 99 in relation to the tongs housing is prevented by the index pins 84 guided in the grooves 80.

It is pointed out once again the operating surface 24 of the tongs lever 14 is so curved that in all positions of the tongs lever it exerts a force on the roller 68 which always have the same angle with respect to the thrust rod.

What I claim is:

1. A tool for exerting bending force on an elongated workpiece, comprising:

a. a housing having one or more counter-pressing elements attached thereto;

b. a thrust rod adapted for sliding movement within said housing relative to said counter-pressing elements, said thrust rod having a smooth surface and a pressing element mounted on its end facing said counter-pressing elements;

c. a sprag being journalled at one end to said housing for pivoting movement with respect thereto and fitted on said thrust rod by means of an opening through which said thrust rod extends, said opening having opposite upper and lower clamping edges, said sprag being adapted in its normal position to block movement of said thrust rod away from said counter-pressing elements;

d. an advancing lever fitted on said thrust rod by means of an opening through which said thrust rod extends, said opening having opposite upper and lower clamping edges which grip against said thrust rod when said advancing lever is in a normal position;

e. a hand lever pivotably connected to said housing and adapted upon movement to advance said advancing lever in its normal position toward said counter-pressing elements and to release said sprag from its normal position, whereby said thrust rod is moved toward said counter-pressing elements;

f. a first spring which urges one end of the advancing lever against an inner end section of said hand lever and biases the advancing lever into its normal position so that said upper and lower clamping edges of the opening of the advancing lever engage against said thrust rod with a tilting action;

g. a second spring positioned between and urging apart said advancing lever and said sprag, said second spring urging the sprag into its normal position, wherein said upper and lower clamping edges of its opening are pressed against said thrust rod with a tilting action; and h. release means on said housing for simultaneously unjamming said sprag and said advancing lever, whereby the bending force exerted by said thrust rod can be released.

2. The tool as claimed in claim 1, wherein said advancing lever includes on the side remote from said hand lever a projection which in the normal position of said hand lever urges said sprag toward its normal position.

3. The tool as claimed in claim 2, wherein said thrust rod and said openings in said sprag and in said advancing lever have a rectangular cross-section.

4. The tool as claimed in claim 2, wherein said thrust rod and said openings in said sprag and in said advancing lever have a round cross-section.

5. The tool as claimed in accordance with claim 4, wherein said openings of said sprag and of said advancing lever are inclined in opposite directions with respect to said thrust rod and wherein a rest for said projection of said advancing lever is arranged on said sprag between said thrust rod and the fulcrum of said sprag.

6. The tool as claimed in accordance with claim 5, wherein the edge zones of said openings of said sprag and said advancing lever are made oblique generally diametrally with respect to the respective clamping edges so as to recede from the center axis.

7. The tool as claimed in accordance with claim 5, wherein said advancing lever includes a rotary roller which is arranged transversely with respect to its longitudinal direction, and acts against said inner end section of said hand lever said lever having an inclined operating surface arranged so that said roller and accordingly said advancing lever experience a force directed towards said thrust rod.

8. The tool as claimed in accordance with claim 7, wherein said inclined operating surface of said inner end section of said hand lever is so shaped that on tightening said hand lever said operating surface always exerts a force, directed at the same angle to said thrust rod, on said roller.

9. The tool as claimed in accordance with claim 8, wherein said release means comprises a release rod, which on being displaced against spring force comes into engagement with said sprag and swings the latter out of its locking position.

10. The tool as claimed in accordance with claim 9, wherein said release means comprises a release knob arranged at the lower end of said housing and said release knob is connected with said release rod.

11. The tool as claimed in accordance with claim 10, wherein said release means comprises a return spring which is connected with said housing and with said thrust rod.

12. The tool as claimed in accordance with claim 11, wherein said thrust rod has index pin extending through and being movable in a longitudinal slot in said housing.

13. The tool as claimed in accordance with claim 12, wherein adjacent to said slot on said housing one or more scales are marked.

14. The tool as claimed in accordance with claim 13, wherein the end of said thrust rod facing said counter-pressing elements has several sections with different diameters for mounting different pressing elements.

15. The tool as claimed in accordance with claim 14, wherein said housing has means for attaching different counter-pressing elements thereto.

16. The tool as claimed in accordance with claim 15, wherein said housing comprises two shells which are connected together by means of cavities and plugs fitting in them for centering and said shells are held together by screws.

17. The tool as claimed in accordance with claim 16, wherein on the outer surface of said housing a plastic or rubber coating is provided in order to improve gripping.

18. The tool as claimed in accordance with claim 4, wherein said pressing and counter-pressing elements are adapted for bending pipes, rods, bands or girders.

* * * * *